US005834678A

United States Patent [19]

Kalb

[11] Patent Number: 5,834,678

[45] Date of Patent: Nov. 10, 1998

[54] BULLPUP .50 CALIBER SEMI-AUTOMATIC TARGET RIFLE

[76] Inventor: Alan I. Kalb, 101 Clubhouse La., Marlboro, N.J. 07746

[21] Appl. No.: 835,271

[22] Filed: Apr. 8, 1997

[51] Int. Cl.[6] ..... F41A 3/44

[52] U.S. Cl. ..... 89/187.01; 89/191.01; 89/143; 42/75.02

[58] Field of Search ..... 89/185, 187.01, 89/187.02, 191.01, 192, 14.3, 182; 42/75.02

[56] References Cited

U.S. PATENT DOCUMENTS

| | | | |
|---|---|---|---|
| 2,112,660 | 3/1938 | Hudson | 89/187.01 |
| 2,527,895 | 10/1950 | Tassan | 89/187.01 |
| 2,576,973 | 12/1951 | Simpson | 89/187.01 |
| 4,475,438 | 10/1984 | Sullivan | 89/185 |
| 4,677,898 | 7/1987 | Malhotra | 89/187.01 |
| 4,942,802 | 7/1990 | Stoner | 89/191.01 |

FOREIGN PATENT DOCUMENTS

| | | | |
|---|---|---|---|
| 2326527 | 12/1974 | Germany | 89/187.02 |

*Primary Examiner*—Stephen M. Johnson

[57] ABSTRACT

A shoulder fired semi-automatic rifle in the bullpup configuration including a housing, a barrel projecting forward from the housing, a bolt mechanism within the housing including but not limited to a firing pin having a system to prevent movement via inertia, a bolt mechanism that utilizes a slidable bolt locking plate and a magazine that works with the bolt mechanism. The trigger and pistol grip are mounted forward of the magazine and ahead of the bolt, the trigger is connected to the hammer sear via a transfer bar linkage.

1 Claim, 8 Drawing Sheets

BULLPUP .50 CALIBER SEMI-AUTOMATIC TARGET RIFLE

BACKGROUND

The need for a .50 semiautomatic target rifle in the "Bullpup" configuration cannot be underestimated. A rifle of this type has many applications in both the civilian and military sector. The civilian market has been clamoring for a .50 caliber semiautomatic rifle for target shooting which could be accurate to 1000 yards while at the same time being compact, reliable and lightweight. My unique design uses many features which accomplish these desired results and make this rifle suitable for military applications.

The idea that a target rifle be less than 30 lbs is critical in my design. The reason it is desirable for the rifle to be less than 30 lbs is for practical purposes, if a target shooter wishes to use the rifle in any position other than prone, the rifle has to be light enough so that the shooter will not become fatigued to quickly. The military also requires a rifle of this type be light enough so that it can be transported easily by small units, and the lighter the rifle means that the troops can carry more ammunition and equipment thereby making them more tactically versatile.

The concept of a compact .50 caliber semi automatic target rifle is also very attractive to both civilian and military users. By making the rifle physically shorter it becomes easier to balance and is quicker to aim. The speed with which a user can acquire a target and successfully engage it is critical to the military because in combative situations that speed could mean the difference between hitting and missing an enemy target. In the civilian world speed in acquiring the target is also important because when competing in a shooting match one of the constraints is time, the user may only have a few seconds with which to engage their target.

Accuracy goes to the heart of the purpose of the rifle. Accuracy has always been a prerequisite by both civilians and the military when selecting a rifle. The ability to accurately engage targets at progressively longer distances has been the goal of all rifles designers since the invention of the musket. By harnessing the immense power of the .50 caliber cartridge and by projecting it accurately it is possible to engage targets in excess of 2000 yards. For the military this means that an enemy target could be engaged long before that enemy target could engage our forces.

The desire for reliability cannot be overstated, whether in competition or combat, a rifles reliability is paramount to the safety of the user. One need only image the deadly consequences of jammed rifle in a combat situation or a ruined weekend for a target shooter who has lost a match due to a faulty rifle.

For the foregoing reasons, there is a need for a bullpup .50 caliber semi-automatic target rifle that is compact, accurate and reliable.

SUMMARY

The present invention is directed to a bullpup .50 cal semi-automatic target rifle that satisfies these needs [needs identified in Background section]. A bullpup .50 cal semi-automatic target rifle having features of the present invention comprises a barrel, a gas tube assembly, a lower receiver, an upper receiver, a trigger assembly, a bolt carrier, and a bolt assembly.

The unique design uses a sliding locking bolt lock which converts linear motion in the horizontal direction to linear motion unlocking the bolt lock in the vertical direction, further my invention uses a linked bolt carrier gas piston assembly which eliminates the need for a giant recoil spring, instead a large gas piston spring supplemented by twin horizontally mounted receiver springs take up the recoil of the giant .50 caliber cartridge. The sliding bolt lock is keyed to a high angle slope on the bolt carrier, which is connected to a gas carrier linkage that is affixed to the gas piston.

The size of the rifle is quite compact because of the unique bolt locking lug plate system combined with the gas piston/bolt linkage assembly. To further reduce size and simplify the design I used a side trigger hammer assembly. While the pistol grip and trigger are mounted in the traditional vertical manner the hammer and sear assembly is mounted on the left side of the lower receiver in a blister which allows the massive bolt carrier more room within the receiver.

By mounting the hammer on 90 degree angle I further reduced size while maintaining fast timing and positive locking. Several unique safety features prevent the rifle from firing out of battery. Both the bolt carrier and the locking lug plate must be in forward locked position before the trigger is allowed to connect with the disconnector firing sear. This feature prevents a possible case head rupture form firing out of battery. The upper receiver is removably affixed to the lower receiver by means of a sliding rail system; because of the use of a machined lower receiver the upper receiver can be fabricated form sheet metal to reduce overall weight. The complete rifle is both lighter and more compact than any of it's contemporaries.

Previous .50 caliber semi-auto rifles were relatively large and cumbersome and heavy. This was necessary in order to facilitate the large and extremely powerful .50 caliber BMG cartridge. Because of the strength of the round all previous systems depended upon heavy components thereby increasing the overall weight of the rifle. The increased weight of subsequent rifles made them awkward to carry and use in the field. By reducing the rifles size and weight but retaining the immense fire power of the .50 BMG cartridge my system will allow the individual soldier to carry more ammunition and equipment thereby increasing the soldiers potential effectiveness in the field.

The recoil control system consists of the twin recoil springs, a large gas piston spring and the multiple chambered muzzle brake. The twin bolt recoil springs assist the gas piston recoil spring in returning the bolt to battery. The last piece is the recoil arresting multi ported muzzle break which acts to divert gasses away from the muzzle.

BRIEF DESCRIPTION OF THE DRAWINGS

FIG. 2 shows the rifle of the invention with a handle for retracting the bolt carrier to the rear held in a rearward position just prior to releasing.

FIG. 3 shows the components of the gun in their respective positions as a cartridge is raked out of the magazine.

FIG. 4 shows the rifle of the invention as the bolt locking plate begins to be forced into the locking plate space by the bolt carrier.

FIG. 5 shows the position of elements of the rifles of the invention as the trigger is released.

FIG. 6 depicts the gas piston forcing the bolt carrier rearward thus unlocking the bolt locking plate and said bolt carrier continuing to travel rearward over the hammer of the gun of the invention, thus cocking the hammer.

FIG. 7 shows how the fired casing is ejected from the rifle of the invention, through a port on the side of the rifle of the invention.

FIG. 8 shows how the cycle is completed when the bolt carrier stops and another cartridge is raked out of the magazine.

DETAILED DESCRIPTION

Figure 1:
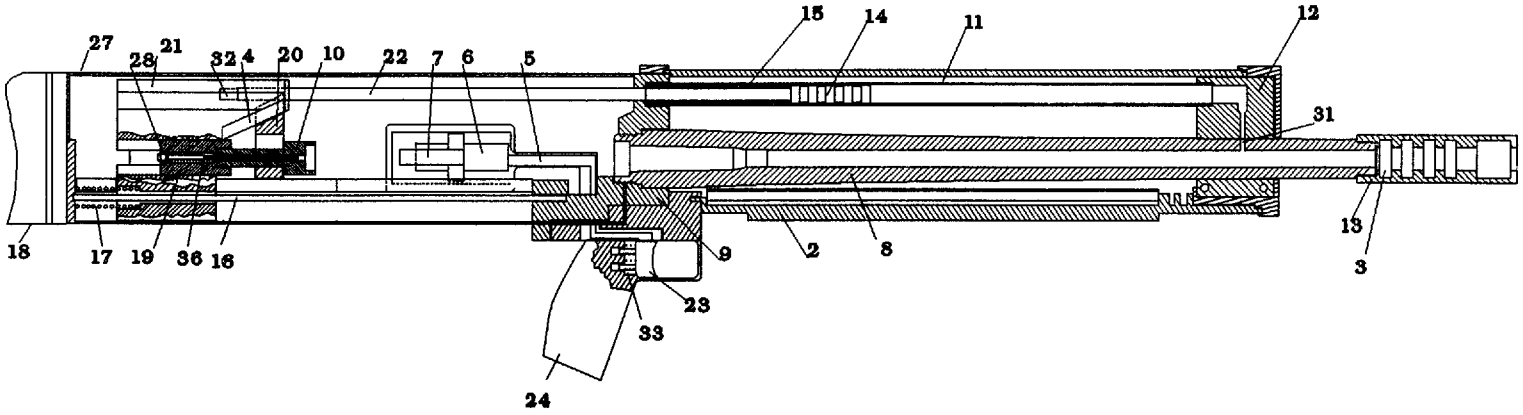
FIG. 1 Is an enlarged side elevation of a semi-automatic rifle made in accordance with this invention, with portions broken away.
Figure 2:
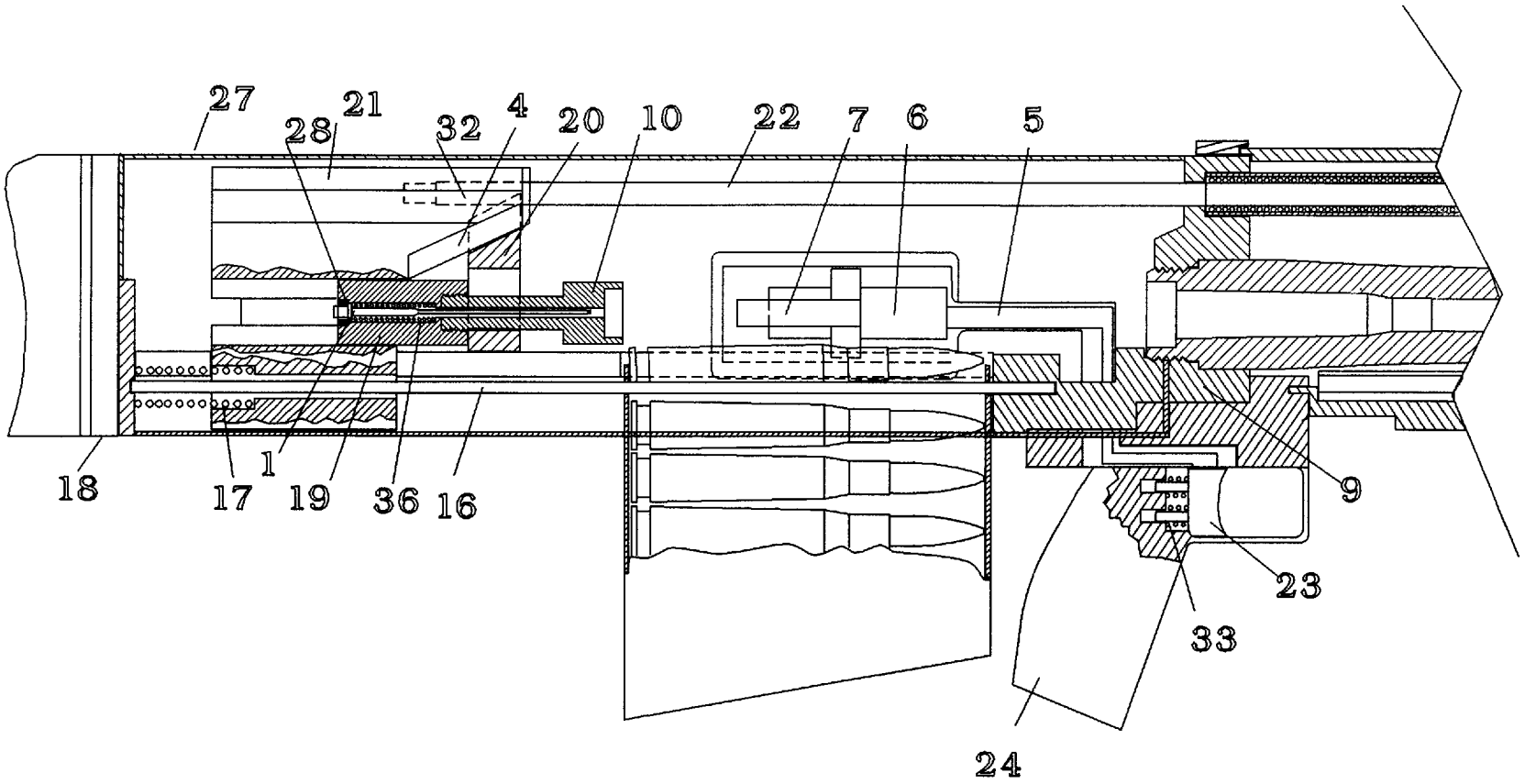
FIGS. 2 through 8 show the components of the rifle made in accordance with this invention in their various positions during the firing cycle, the views are from one side, and partially broken away and in longitudinal cross section.
Figure 3:
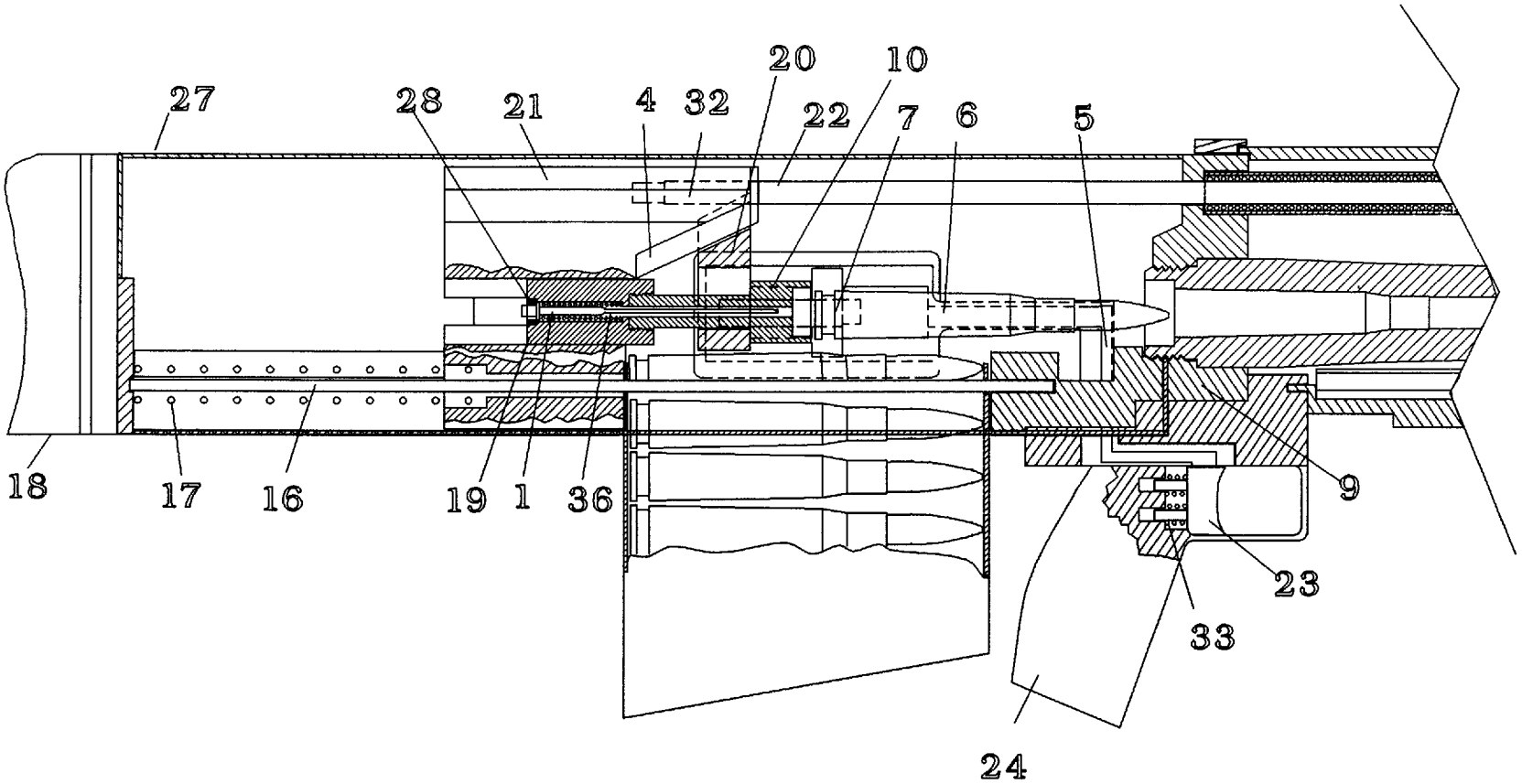
Figure 4:
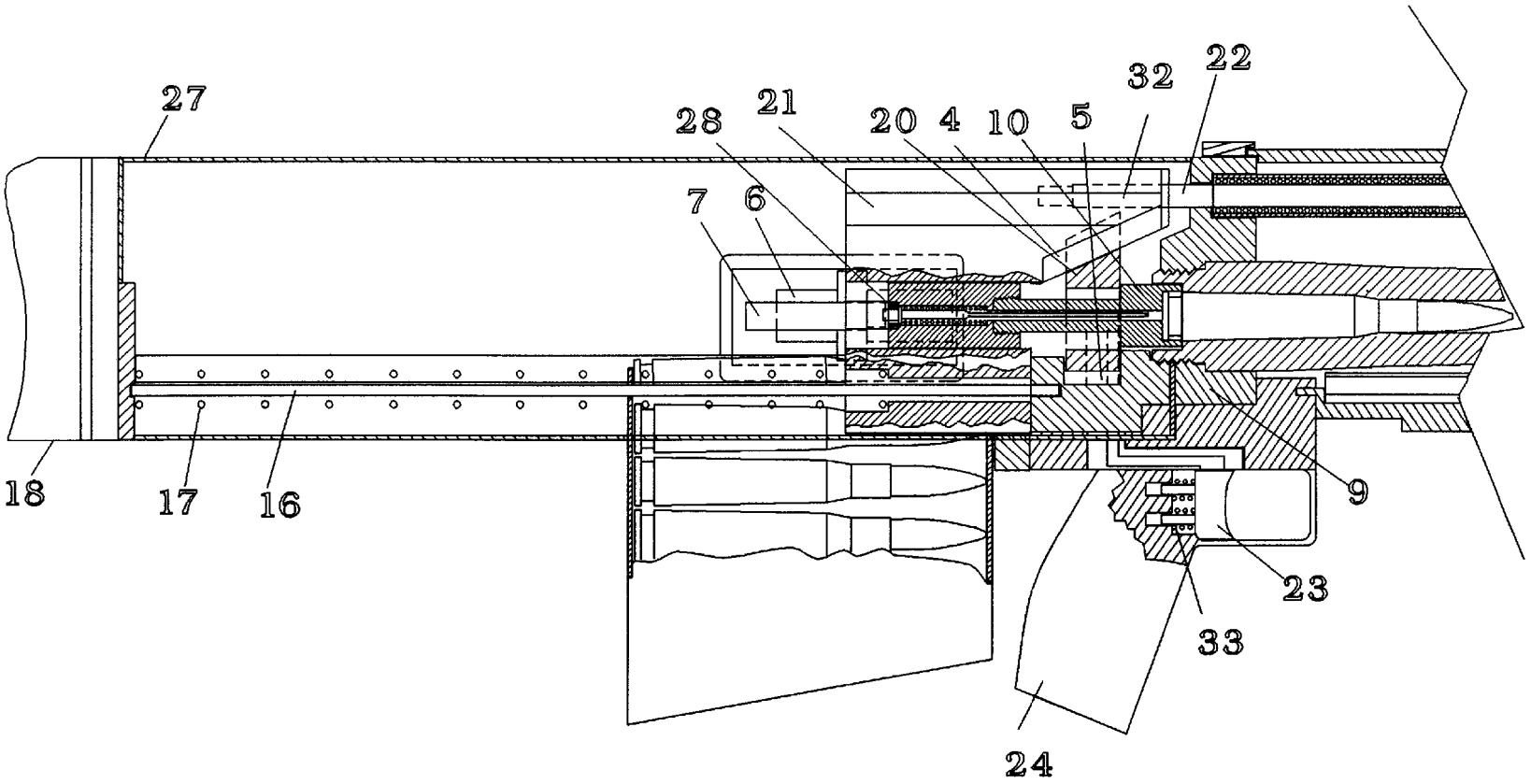
Figure 5:
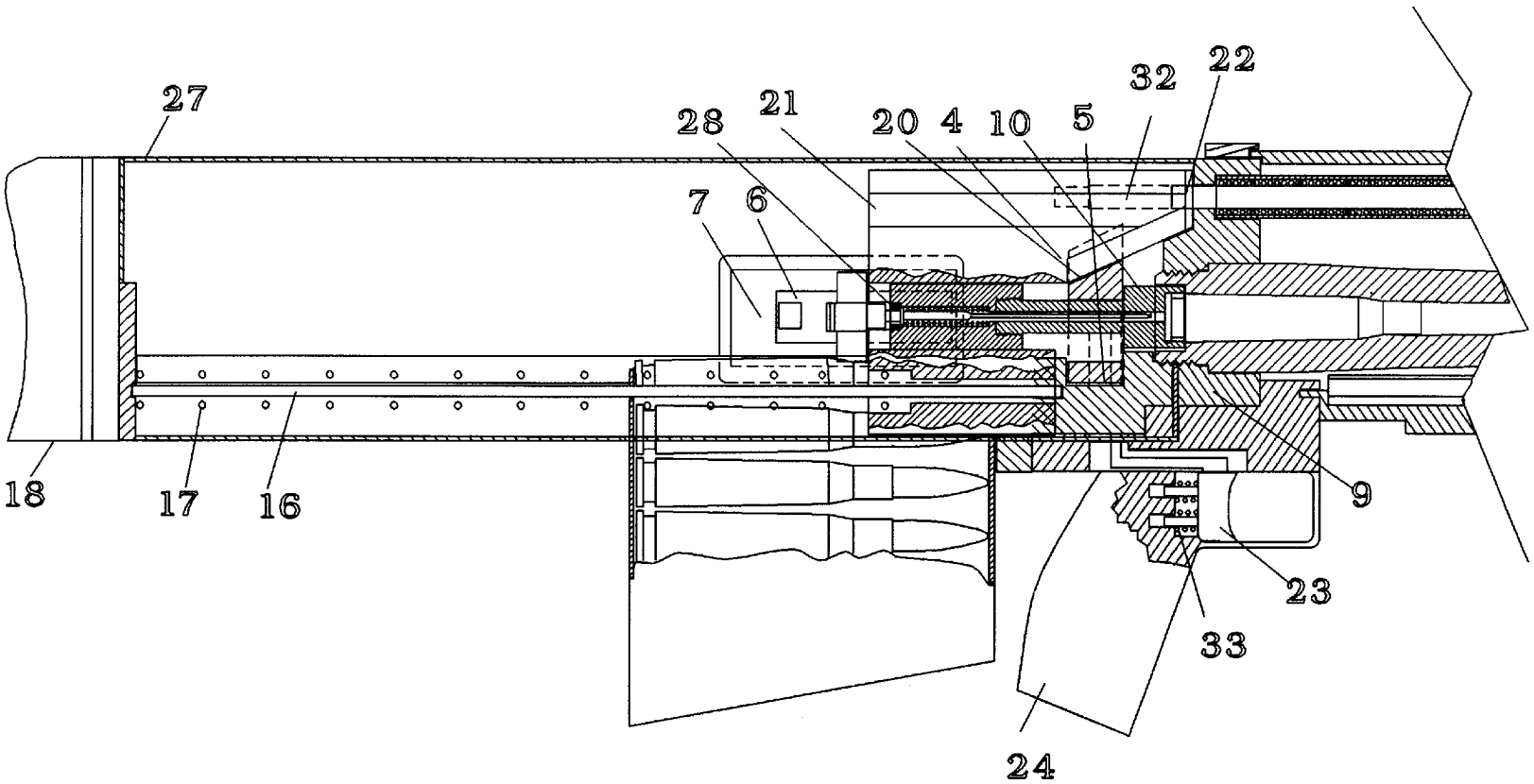
Figure 6:
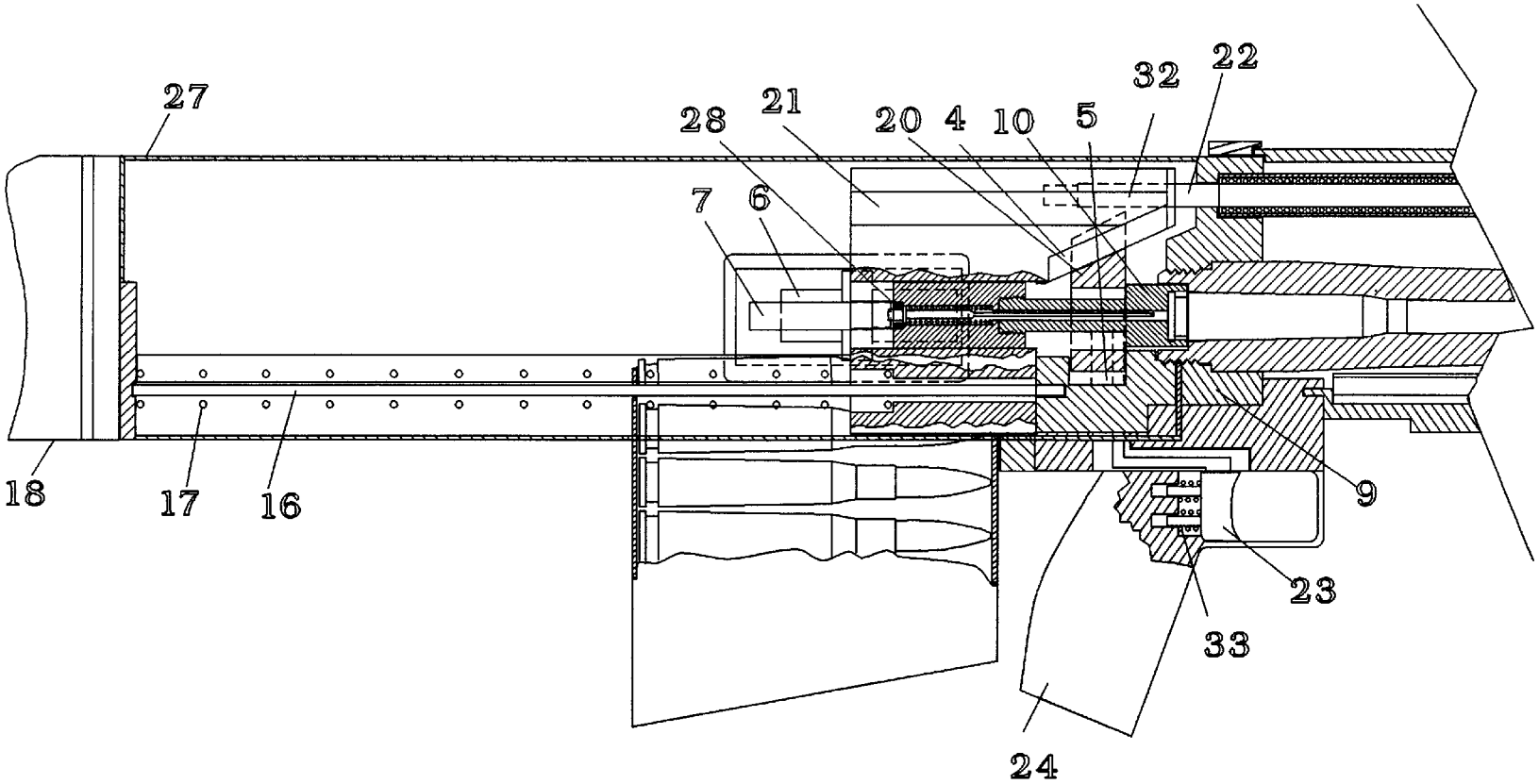
Figure 7:
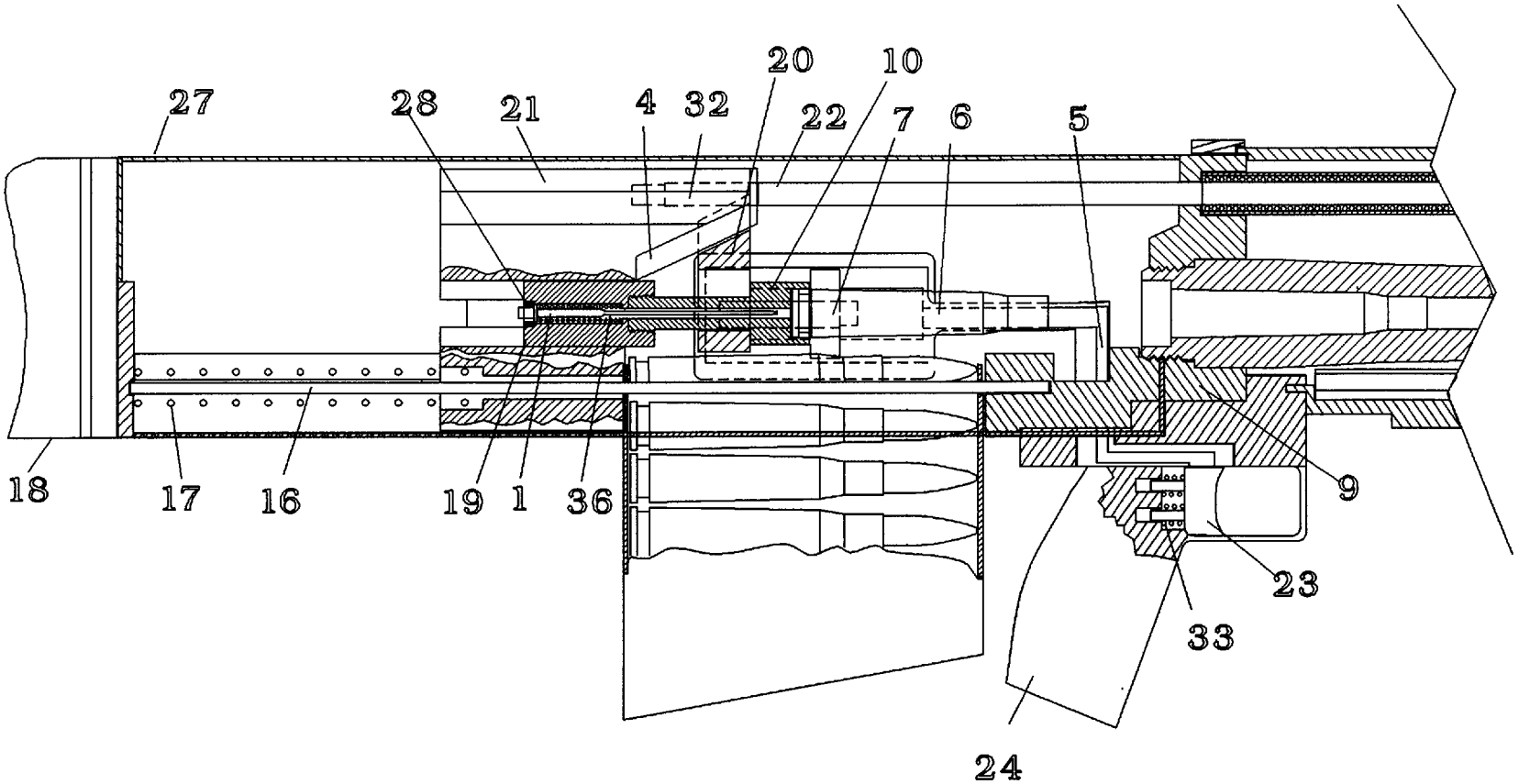
Figure 8:
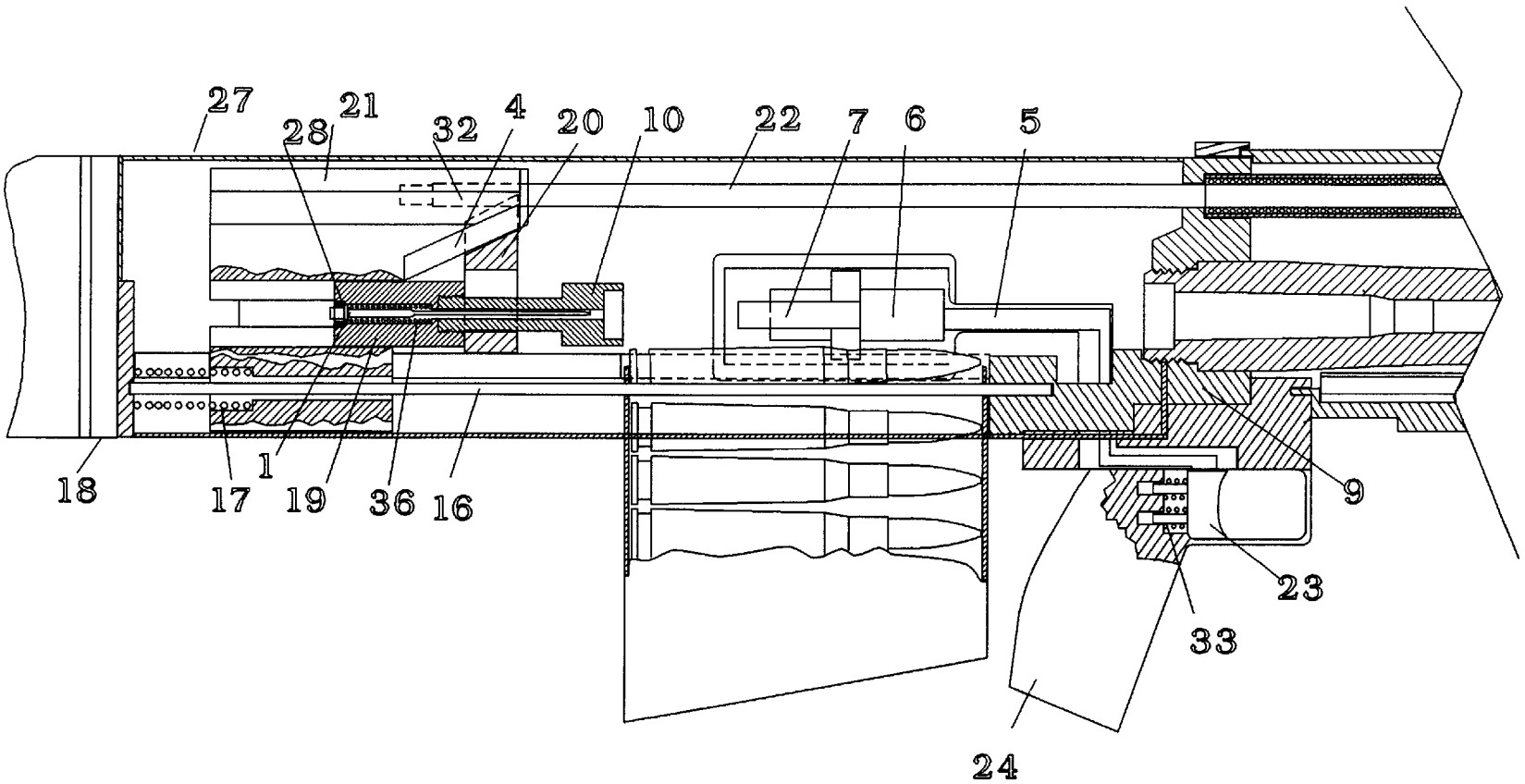

Referring now to the drawings in more detail, action mechanism; bolt locking features; the bolt 10 has a rearward octagonal female portion which is threaded to receive the threaded cylindrical male forward portion; the bolt 10 is slidably affixed to the bolt locking plate 20 which moves in an up and down motion while the bolt is retained by a dovetail rail 4, the bolt locking plate 20 is slidably affixed to the bolt carrier 21 which transmits horizontal motion the bolt locking plate 20 which is converted by the locking plate 20 into vertical motion. Thus the bolt locking plate 20 rises out of the locking lugs in the mating receiver 9 and begins a rearward travel. The bolt 10 remains stationary while the bolt locking plate 20 is moving horizontally and the bolt carrier 21 is moving vertically. When the bolt locking plate 20 ceases to travel vertically and begins it's rearward travel it begins to bring the bolt 10 with it in the direction of travel of the bolt carrier 21, the entire assembly is now moving in the same direction.

At the rearward stroke, the bolt 10 extracts and ejects the spent cartridge casing 30 being assisted by gases from the cartridge 30. As the bullet travels down the barrel 8 it reaches the gas port 31, a small hole in the barrel 8, the bullet passes the hole and small amount of high pressure gas from the expanding cartridge 30 enters the hole and is directed rearward against the gas piston 14 which is then forced rearward, this causes the piston 14 which is attached to the bolt carrier 21 via the bolt carrier linkage 32 to push the bolt carrier 21 rearward unlocking the bolt locking plate 20 which is slidably attached to the bolt 10. This in turn causes the bolt 10 to be forced rearward extracting and ejecting the spent cartridge casing 30.

The trigger mechanism is comprised of a trigger 23 a trigger return spring 33 a trigger transfer bar 5 a disconector sear 6 and a hammer 7. The second stage is mounted 90 degrees on the left of vertical. This allows the design to remain quite compact without a trigger mechanism taking up valuable space. The trigger 23 is depressed which is placed against the transfer bar 5 which contacts the hammer sear, this is unlocked by the dissconector 6 which is a secondary safety which prevents the sear from accidental release, once the disconector releases the hammer sear, the hammer 7 is propelled by spring force to make contact with the firing pin 1. The firing pin 1 then travels forward making contact with the primer of the chambered cartridge 30 with sufficient inertial force to detonate the primer discharging said cartridge 30.

The firing pin inertia spring 36 prevents the pin 1 from travel until it has been impacted by the hammer 7. The firing pin inertia spring 36 is housed in the bolt 10 and is sandwiched between the bolt 10 and around the firing pin 1 itself The pin 1 is designed to prevent over travel, breakage and specifically to prevent the inertia of the bolt 10 from causing it to travel. The firing pin sub assembly consists of a firing pin 1, firing pin spring 36 and a firing pin retaining block 28. All of which are housed in the bolt 10. The firing pin 1 is kept static via the firing pin spring 36 and the firing pin retaining block 28. The retaining block 28 prevents the pin 1 from falling out of the bolt 10 while the combination work together to hold the pin 1 under a limited load via spring tension until the hammer 7 is released.

I claim:

1. A rifle comprising:

(a) a lower receiver assembly;

(b) an upper receiver assembly having a bolt carrier assembly slidably located therein, said upper receiver is attached to lower receiver assembly;

(c) a buffer spring assembly mounted in said upper receiver and arranged to cause said bolt carrier to be urged forward;

(d) a rifle barrel having a cartridge chamber, said barrel being fixed to said lower receiver, in which said barrel is arranged to mate with a bolt;

(e) a gas operated system in which high pressure gas is directed from said barrel through a gas block to said bolt carrier assembly;

(f) said bolt having two sections, a front and a rear, the front being cylindrical in shape to engage said barrel, the rear being octagonal so as to engage in a slidable fashion said bolt carrier;

(g) a bolt locking plate having a locking lug section to engage a lower receiver locking lug receiver, and a portion on the opposite end to receive a dovetail rail of said bolt carrier.

* * * * *